United States Patent [19]

Nayar

[11] 3,975,193

[45] Aug. 17, 1976

[54] POWDER METALLURGY PROCESS FOR PRODUCING STAINLESS STEEL STOCK

[75] Inventor: Harbhajan S. Nayar, Plainfield, N.J.

[73] Assignee: Airco, Inc., Montvale, N.J.

[22] Filed: Apr. 18, 1973

[21] Appl. No.: 352,386

[52] U.S. Cl. ..... 75/211; 29/420.5; 75/200; 75/224; 75/226; 148/126

[51] Int. Cl.[2] ..... B22F 1/00; B22F 3/16

[58] Field of Search ..... 75/226, 224, 200, 211; 148/126; 29/420.5

[56] References Cited

UNITED STATES PATENTS

| | | | |
|---|---|---|---|
| 2,370,396 | 2/1945 | Cordiano | 148/126 X |
| 2,826,805 | 3/1958 | Probst et al. | 148/126 X |
| 3,073,695 | 1/1963 | Silbereisen et al. | 148/126 X |
| 3,126,279 | 3/1964 | Bergh | 75/200 |
| 3,268,368 | 8/1966 | Mackiw et al. | 148/126 X |
| 3,334,999 | 8/1967 | Naeser | 75/200 X |
| 3,668,024 | 6/1972 | Johnson | 148/126 |
| 3,725,142 | 4/1973 | Huseby | 148/126 X |
| 3,744,993 | 7/1973 | Matt et al. | 148/126 X |

OTHER PUBLICATIONS

Brown et al., *Experimental and Practical Aspects of the Powder Forging Process*, in Int. J. Pow. Met. 6(4): pp. 29–42, 1970.

Hirschhorn et al., *The Forging of Powder Metallurgy Preforms*, in Metal Forming 37(11): pp. 320–327, 1970.

Wick, C. H., *Forging Gears from Powder Metal Preforms*, in Mach. & Production Eng. vol. 117, Oct. 21 1970, pp. 668–670.

*Application Outlook for Forging P/M Preforms*, in Metal Progress 99(4): pp. 54–60, 1971.

*Primary Examiner*—Richard E. Schafer

*Attorney, Agent, or Firm*—David L. Rac; H. Hume Mathews; Edmund W. Bopp

[57] ABSTRACT

A powder metallurgy process for producing stainless steel stock. The process utilizes readily available, inexpensive, oxygen- and carbon-bearing raw materials and yields stainless steel stock of high purity with a low level of interstitials. After determining the degree of homogeneity desired, the process consists of providing an alloy composition from a particle mass comprising iron, chromium- and/or nickel-bearing powders containing oxygen and carbon, purifying the particle mass in an uncompacted condition in order to obtain a coherent porous compact with a desired purity level and then hot working the compact to produce a homogeneous and densified product. The properties of the product produced by this process are comparable to properties of a wrought product of similar chemical composition.

11 Claims, No Drawings

POWDER METALLURGY PROCESS FOR PRODUCING STAINLESS STEEL STOCK

BACKGROUND OF THE INVENTION

1. Field of the Invention

This invention relates to a powder metallurgy process for manufacturing stainless steel stock. More particularly, this invention relates to a process for producing high purity stainless steel stock from inexpensive oxygen- and carbon-bearing raw materials.

2. Description of the Prior Art

The production of semi-finished metallic stock destined for processing into a final product can be accomplished by conventional metalurgical techniques, e.g., melting, casting and working, thereby producing a wrought product or by powder metallurgy techniques. To obtain a semi-finished wrought product, such as bar, rod, plate, sheet or the like, a melt of a specific chemical analysis is provided. The melt is continuously cast into a slab, billet or bloom or cast into an ingot and then thermo-mechanically worked into the desired semifinished form.

It is well known that wrought alloys have disadvantages and limitations. Some of the more apparent shortcomings include: segregation (which requires processing steps to improve homogeneity, such as working and annealing) work hardening, shape limitations, large sections required and directionality resulting from substantial reductions in area.

Production of semi-finished metallic stock by powder metallurgy techniques offers the following advantages over production of wrought stock:

A smaller intermediate is required, one that is closer to finished size than either a wrought ingot, slab, bloom or billet. For example, a 50 – 100 mil thick sintered compact could yield a 10 mil strip with properties equivalent to a wrought product of similar composition. This eliminates the more conventional large wrought sections that normally require massive equipment to effect reductions in area.

Powder metallurgy stock is also characterized by reduced or minimal segregation. This is due in part to the utilization of a particle mass having a chemical analysis equivalent to the final product. Furthermore, each individual particle can be considered to be micro-ingot having the desired alloy composition. The finished stock might therefore be considered as having, at worst, micro-segregation as opposed to the objectionable macro-segregation characteristic of wrought stock.

Product forms consisting of compositions that work harden easily, such as ferritic stainless steels and cupronickel alloys can now be produced by powder metallurgy. To produce these product forms from alloys in the wrought form requires many processing steps to reach a homogeneous product of the desired dimensions, because with each step that reduces the cross-section an annealing step is required to remove work-hardening and restore ductility. Since powder metallurgy can produce stock closer to the desired final dimensions, the problem of work-hardening is considerably minimized.

Powder metallurgy can also produce stock not easily attainable, if at all, in the wrought form because of control over macro- and micro-structure and density. For example, composite structures and dispersion strengthened materials can now be produced by powder metallurgy.

Although the production of metallic stock by powder metallurgy techniques offers the aforementioned advantages over metallic stock produced by more conventional techniques, powder metallurgy has long been faced with limitations and disadvantages due to certain economic and technical problems. These problems include particle characteristic requirements, difficulties with powder feeding and the relationship of finished stock size and equipment capabilities.

Particle characteristics that effect product and process applications include particle size, shape and distribution, compressibility, flow rate and presence of various interstitial elements, e.g., carbon, nitrogen, sulfur, boron, oxygen and phosphorous. Prior metallurgical processing of the particles, such as annealing, pre-alloying or blending, is a further influencing characteristic. Other significant characteristics include the presence and distribution of various metallic oxides.

To transform a particle mass into a resultant rod, bar, plate or sheet product with sufficient green strength for subsequent handling, a reasonably high compacted density is required. This density is controlled by particle size, shape, distribution, compaction, pressure and compressibility. If the particle mass is a coarse, spherical pre-alloyed powder, the compacting pressure required to produce a compact with sufficient green strength is extremely high or impractical to achieve.

Normally particles have an oxide layer. The presence of this layer interferes with the compacting process. Unless this layer is removed, the finished product will have low ductility and poor mechanical and corrosion properties. When the compact is sintered the oxide layer will be removed by deoxidation. To facilitate deoxidation economically, the compacted particle mass must have some interconnected porosity. Deoxidation can be accelerated by sintering at an elevated temperature for an extended time period and in a dry reducing atmosphere. However, interconnected porosity, during compaction, will considerably reduce the green strength of the compact particularly if a coarse, pre-alloyed powder is used. Even if a suitable compact with interconnected porosity is attained the compact must be subjected to extensive processing in order to obtain a finished product with properties equivalent to a comparable wrought product. Therefore, a compromise is usually reached between green strength and amount of deoxidation with an associated effect on properties.

Compacting pressures can be considerably reduced by the selection of powders that will constitute the particle mass. However, this is not the panacea for curing compacting problems. For example, by using fine, oxide-free, irregular and fullyannealed pre-alloyed stainless steel powders which have a low level of interstitials, a reduced compacting pressure can be employed. However, powders with these properties are expensive, thereby making the use of powder metallurgy stock less attractive from an economic viewpoint. Likewise, using a blend of elemental powders, such as iron, chromium, nickel or manganese, also results in reduced compacting pressures. These powders normally have an oxide film that must be removed. Unless this film is completely removed, the resultant compact will have lower ductility, mechanical properties and corrosion properties than a comparable wrought product.

In direct particle rolling, feeding of blended powders is also a problem because maintaining a uniform rate of feed is difficult with respect to width and thickness. Furthermore, blended powders tend to segregate to a considerable extent during feeding and rolling. For example, in the production of stainless steel stock with a nominal composition of 18% chromium and 8% nickel, a blend of iron, chromium, nickel, silicon and manganese powders is employed. These powders have different particle characteristics and during processing into strip or plate tend to segregate toward each other, thereby producing a structure with non-uniform distribution of particles of various compositions.

Direct particle rolling of blended powders into strip usually generates edge and lateral cracking. This phenomena usually increases with increased rolling speed. Furthermore, the powders used in direct particle rolled strip must be completely pre-dried, otherwise the strip will develop cracks and blisters during sintering. It is readily apparent that these defects lower the efficiency of direct particle rolling.

A further limitation in the production of metallic stock via powder metallurgy techniques is that the cross-sectional thickness of the resultant product is limited to relatively thin strips or sheets. As pointed out in U.S. Pat. No. 3,389,993, strip thickness is limited by the diameter of the compacting rolls. To roll compact products of a relatively thick cross-section, very large diameter rolls and supporting equipment is required. For example, to produce a 0.5 inch diameter rod, rolls 250 to 500 inches in diameter would be required. This patent overcomes the restriction on cross-sectional thickness by assembling a plurality of slit green strips, followed by sintering and mechanical working. Although the problem of cross-section is overcome by the teaching of this patent, a second problem of product width is introduced.

The method of this invention offers the typical advantages of powder metallurgy over the conventional production of wrought metallic stock. Furthermore, the method overcomes the above-mentioned limitations normally associated with conventional powder metallurgy techniques.

SUMMARY OF THE INVENTION

It is an object of this invention to provide a powder metallurgy process for producing stainless steel stock with mechanical and corrosion resistance characteristics comparable to wrought stainless steel stock.

A further object of this invention is to produce stainless steel stock with a low interstitial level from an economical source such as a inexpensive oxygen- and carbon-bearing raw materials.

Still a further object of this invention is to provide a method for producing stainless steel stock that does not require compaction of the particles before sintering.

Another object of this invention is to provide a method for producing metallic stock wherein the limitations on the product width and cross-sectional thickness is considerably minimized A further object of this invention is to provide a powder metallurgy process for producing metallic stock that eliminates powder feed problems resulting from powder turbulence due to feeding between rolls.

A further object of this invention is to provide a stainless steel stock which is suitable for welding rods and strip.

A further object of this invention is to provide a powder metallurgy process for producing metallic stock from blended powders that eliminates the segregation, cracking and blistering problems associated with direct particle rolling.

These and other objects are achieved by providing an alloy composition in an uncompacted state from a particle mass comprising pre-alloy powders or an iron bearing powder with a chromium- and/or nickel-bearing powder containing oxygen and carbon and maintaining a specific oxygen to carbon plus sulfur ratio. The uncompacted mass is then purified and sintered in a reducing or protective atmosphere so as to produce a desired purity level and a coherent porous compact. The purified compact is then mechanically hot-worked so as to substantially remove all vestiges of porosity, thereby producing a densified product. Thee homogeneity level of the finished product is controlled by powder selection and product application.

The advantages of the method of this invention will be apparent from the following detailed description in which:

DESCRIPTION OF THE PREFERRED EMBODIMENT

The method of this invention utilizes either readily available or economically producible inexpensive raw materials and produces stainless steel stock with a low level of interstitials and properties comparable to wrought stainless steel stock. As used herein, the term "wrought" signifies conventional melting, casting, and working.

A significant parameter that should be discussed at this point is that of homogeneity. This parameter controls the selection and quality of raw materials (starting powders) that ultimately yield the powder metallurgy metallic stock.

It is well known in the art that homogeneous metallic stock is stock having identical characteristics throughout. There are two types of homogeneity, physical homogeneity, requiring only an identity of lattice type throughout, and chemical homogeneity, requiring uniform distribution of alloying elements.

It is chemical homogeneity that is to be considered in this description. Chemical homogeneity can be attained by a heat treatment at an elevated temperature which eliminates or decreases chemical segregation and by judicious selection of powders that comprise the starting particle mass as hereinafter more fully described.

The homogeneity of the stock produced by this process can range from slightly homogeneous for non-critical product applications, such as welding rods, to fully homogeneous for critical product applications, such as stock, for use in highly corrosive media.

The starting poing for this process is the preparation of a particle mass. A particle mass is defined as a single pre-alloy powder or combination of powders formulated to yield metallic stock of a specific alloy composition, homogeneity level and purity level.

When the particle mass is a blend of powders, individual constituent powders can be either elemental or prealloyed powders. The blend could consist of two or more prealloy powders, two or more elemental powders or a combination of pre-alloy powders and elemental powders. Homogeneity level is the controlling parameter that governs powder selection.

An elemental powder is a powder consisting primarily of a metallic element such as iron, nickel, chromium or copper which is combined with some non-metallic impurity such as oxygen, carbon or sulfur.

Pre-alloy powders, on the other hand, are by their nature completely homogenous and all particles having essentially the same composition. These powders, such as 18% chromium - 8% nickel and ferro-chromium are usually obtained from a molten melt of a desired composition.

Homogeneity of metallic stock can be changed by varying the ratio of elemental and pre-alloy powders in the blend, by the particle size of the constituent powders and by thermomechanical treatment.

Since pre-alloy powders are inherently homogeneous increasing the amount of this type of powder automatically insures a higher level of homogeneity in the finished stock. It is well known in the art that the particle size of constituent powders varies over a wide range. By selecting powders with a uniformly small size the level of homogeneity will also increase. Thermo-mechanical working wherein the stock is reduced in cross-section, annealed and further reduced ultimately produces a product with a fairly homogeneous structure.

The constitution of different particle masses can be shown by the following illustrations:

a. Particle mass blended to yield stock exhibiting a low level of homogeneity.

An example of metallic stock requiring a specific alloy composition, a low level of interstitials but not a homogeneous structure, is welding rod. The essential requirement of a welding rod is chemical composition and not chemical homogeneity because the physical structure of the rod is ultimately destroyed. Chemical composition can be attained by the process of this invention utilizing a blend of elemental powder(s) or a blend of elemental and standard inexpensive pre-alloy powders such as ferro-chromium.

b. Particle mass blended to yield stock exhibiting an intermediate level of homogeneity.

An example of metallic stock that can tolerate a certain amount of inhomogeneity would be rod, bar, sheet or strip for structural applications where mechanical properties are important. As the application becomes more critical, for example, exposure to increasingly more corrosive atmospheres, the proportion of pre-alloyed powders to elemental powders can be increased.

c. Particle mass selected to yield stock exhibiting a high level of homogeneity.

An example of metallic stock requiring a specific alloy composition, a low level of interstitials and a completely chemical homogeneous structure is stock exposed to highly corrosive media. To attain this level of homogeneity the proportion of pre-alloy powders to elemental powders, in the blend, will be quite high. To achieve the highest level of homogeneity practically attainable, one would select a particle mass consisting entirely of pre-alloy powders. If chemical homogeneity is not achieved corrosive attack may start at grain boundaries, areas depleted or less rich (due to segregation) in corrosive resistant elements, e.g., chromium, thereby resulting in premature failure.

The ability to utilize inexpensive and readily available raw materials obviates the necessity for powders with special characteristics, i.e., size, shape, compressibility, metallurgical state, rate of feed, or purity. It will become apparent that powders containing oxygen and carbon are more desirable than higher purity powders.

A particle mass is prepared that provides the composition of the desired alloy. If austenitic stainless steel stock is desired, iron, chromium- and nickel-bearing powders are utilized. Likewise, if ferritic stainless steel stock is desired, iron-bearing and ferro-chromium powders are utilized. The particle mass must contain the constituent elements in the correct weight percent as appearing, for example, in Table 1, p. 409, of the Metals Handbook, Vol. 1. Aside from providing the correct nominal chemical composition, it is also important that the weight percent of oxygen to the weight percent of carbon plus sulfur, be present in a definite ratio. In order to obtain stainless steel with a low level of carbon, oxygen, nitrogen and sulfur, the weight percent of oxygen to the weight percent of carbon plus sulfur, must be present within the ratio of 1 to 2.5.

Purification of readily available, inexpensive, oxygen- and carbon-bearing raw materials used for a starting particle mass can be explained by the following four chemical equations:

| | | |
|---|---|---|
| (1) | $2C + O_2\ 2 \rightarrow 2CO$ or $(CO_2)\uparrow$ | decarburizing and deoxidizing |
| (2) | $C + 2H_2 \rightarrow CH_4\uparrow$ | decarburizing |
| (3) | $2H_2 + O_2 \rightarrow 2H_2O\uparrow$ | deoxidizing |
| (4) | $S + O_2 \rightarrow SO_2\uparrow$ | desulfurizing and deoxidizing |

As hereinafter more fully explained, these equations represent the mechanism whereby the amounts of carbon, oxygen and sulfur are reduced to exceptionally low levels.

The reaction products of these equations are gaseous in nature. During purifying and sintering the uncompacted particle mass becomes a coherent porous compact. This intermediate product exhibits a high degree of interconnected porosity thereby providing a network for the easy escape of these gases with a resultant lowering of the carbon, oxygen and sulfur contents before thermo-mechanical work and closes off the porous network.

There is a concentration gradient established within the compact between the porous network and the particle network which results from a high concentration of carbon, sulfur, nitrogen and oxygen in the particles and a very low concentration of these elements in the porous network. During purification the entire compact is seeking to achieve chemical equilibrium. In order to achieve this state, interstitial atoms in areas of high concentration, particle network, migrate kinetically to areas of lower concentration, porous network. In the case of gaseous products such as the reaction products of equations 1 through 4, these products merely diffuse out of the compact through the porous network. Diffusion proceeds until the concentration gradient has been so reduced that the porous network and the particle network are essentially in equilibrium. At this point carbon, oxygen and sulfur are present at very low levels.

It is well known in the art that nitrogen is another element that should be present in low levels. The exact mechanism whereby the nitrogen content is reduced is not fully understood, however, it is speculated that this element is removed by virtue of the principles of solubilities and kinetics and not by the mechanism of the aforementioned chemical equations.

The nitrogen content of metallic stock produced by the method of this invention is lower than the nitrogen content of metallic stock produced by conventional metallurgical techniques for two reasons. Firstly, nitrogen has an appreciable solubility in the liquid state and a much lower solubility in the solid state. It follows then that a wrought product produced from a refined molten melt will have in solid solution a higher nitrogen content than will a product produced by the method of this invention because the refining or purifying temperature is substantially lower than the melt temperature.

Secondly, when the particle mass is heated during refining or purifying, nitrogen is evolved also kinetically and passes off through the interconnected porous network because of the concentration gradient within the compact in a manner as hereinbefore described.

Reactions 1 through 4 are dependent upon the amount and ratio of weight percent of oxygen to the weight percent of carbon plus sulfur in the composition of the particle mass. The broad range for this ratio is 1 to 2.5 and the narrow, preferred range is 1 to 1.6.

Operating outside the limits of the broad range reactions 1 through 4 would qualitatively proceed in the following manner: If the oxygen to carbon ratio is low, i.e. below 1, reaction 1 will proceed and the final oxygen content will tend to be low whereas the final carbon content will tend to be high. With a deficiency of oxygen, carbon can only be removed through the mechanism of reaction 2 by the formation of methane which is not economically attractive because this reaction occurs over a long period of time in a flowing dry atmosphere. It is well known in the art that carbon can also be lowered by usig a high-dew point atmosphere. This is not a practice that should be followed here because such an atmosphere will oxidize chromium, manganese and silicon, elements normally present in stainless steel stock. Reactions 3 and 4 are expected to occur slowly because of the oxygen deficiency. Therefore, the sulfur content will probably not be affected.

If the oxygen to carbon ratio is high, i.e. above 2.5, reaction 1 will proceed rapidly due to the considerable affinity of carbon and oxygen for each other at elevated temperatures and the resultant carbon content will be low. The final oxygen will tend to be high, however, reactions 3 and 4 should consume some of the excess oxygen. Reaction 3 will proceed in a flowing dry hydrogen atmosphere, over a long time period. Reaction 4 will operate to reduce the final sulfur content. Reaction 2 is not operative because of the low carbon content.

In summary, purification at an elevated temperature of an uncompacted particle mass is dependent upon two factors, oxygen to carbon plus sulfur ratio and an interconnected porous network. An oxygen to carbon plus sulfur ratio in the broad range of 1 to 2.5 insures a rapid removal of carbon, oxygen and sulfur, however, a more preferable range is 1 to 1.6. This preferred range results in a slightly less rapid removal of carbon, oxygen and sulfur, however, it is significant to note that an excess of carbon or oxygen does not remain in the purified particle mass. An interconnected porous network provides an easy avenua for the gaseous products containing carbon, oxygen, sulfur and nitrogen to diffuse from the particle mass and thereby creating a concentration gradient.

A final significant parameter which must be considered is hot densification of the compact. In order to attain a finished product with a wrought structure and a very high density, some form of hot densification must be performed. The sintered and purified coherent porous body has approximately 30 to 70 percent porosity depending upon the particle mass selected and the refining and sintering parameters employed.

Hot densification must produce substantial lateral flow in one or more directions. This can be accomplished by rolling, extrusion, swaging and forging. By creating lateral flow in the porous body a high density metallic body is produced with a micro-structure resembling an annealed wrought product. All vestiges of the original interconnected porous network have totally disappeared. If there is considerable lateral flow during densification, good mechanical properties will also be attained.

If the hot densification of the porous compact is accomplished by rolling in a protective atmosphere, the desired material flow can be obtained by a 40 percent or more reduction in thickness in one pass. Since the porous compact consists essentially of particles without any oxide, surface layer bonding between particles is achieved during heavy deformation, resulting in superior mechanical properties.

The operation of this invention can best be explained by reference to the following examples.

EXAMPLE I

Particle mass blended to yield stock exhibiting a low level of homogeneity.

Finished Product-Type 308 austenitic stainless steel welding rod

A. Prepare Particle Mass

| Constituent | Percent | Particle Size |
|---|---|---|
| Iron powder | 48.0 | 100 mesh |
| Nickel powder | 10.0 | — |
| Fe-Cr powder | 42.0 | — |

Remarks

1. Fe-Cr powder composiition: 48.7% Cr; 43.7% Fe; approx. 0.5% C; 3.1% Mn; 1.2% Si
2. Particle mass composition: 0.27% C; 0.57% $O_2$; 0.0455% $N_2$; 22% Cr; 10% Ni; 1.13% Mn; 0.5% Si; balance Fe
3. Oxygen to carbon plus sulfur ratio: 2.1 (approx)
4. Density: 3.82 grams/cc or 48.3% theoretical density B. Direct Particle Sinter The particle mass is placed, uncompacted, into a supporting structure and sintered for 1 hour, in a hydrogen atmosphere, at 1300°C. The sintered particle mass is thereafter cooled to room temperature.

Remarks

1. Sintered particle mass composition: 0.0302% C; 0.2271% $O_2$; .0047% N
2. Density: 64.1% theoretical density
3. Product dimensions: 0.675 inch thick × 1.34 inch × 5.7 inch C. Hot Densification The sintered particle mass is heated to rolling temperature by heating for ⅓ hour in a hydrogen atmosphere at 1100°C with a dew point of 20–35 ppm $H_2O$ plus 10 mins. in Argon. The reheated particle mass is then hot rolled in a protective atmosphere and reduced in thickness 65.4% in a single pass.

The product obtained after hot densification illustrates another significant feature of this invention. As hereinbefore pointed out in U.S. Pat. No. 3,389,993, strip thickness is limited to about 1/100 to about 1/50 of the diameter of the compacting rolls. This patent further discloses that in order to produce a 0.5 inch thick section, rolls 250 to 500 inches in diameter would be required. Therefore, to produce the 0.234 inch thick section of this example, rolls approximately 125 to 250 inches in diameter would be required. This section, however, was produced with a roll diameter of 7½ inches, clearly a definite advantage over the prior art.

Remarks

1. Dimensions after hot rolling: 0.234 inch thick × 1.54 inch× 10.125 inch
2. Density: 91% theoretical density
3. Composition: 0.005% C; 0.0620% $O_2$; 0.0031% N (This further reduction in carbon, oxygen and nitrogen is attributed to the low dew point of the reducing atmosphere)
4. Comparative analysis:

| | Weight Percent | | | | |
|---|---|---|---|---|---|
| | C | Cr | Ni | Mn | Si |
| Invention | .005 | 22 | 10 | 1.13 | .50 |
| Type 308 | .08 max. | 19–21 | 10–12 | 2.00 max. | 1.00 max. |
| Type 308L (nominal) | 0.025 | 21 | 10 | 1:75 | .40 |

(The analysis of the product of this invention satisfies Type 308 and more than meets the required interstitial level of the restrictive grade Type 308L)

5. Comparative Mechanical Properties:

| | Product of Invention | Wrought Type 308* |
|---|---|---|
| Ultimate Tensile Strength (psi) | 80,000–82,000 | 85,000 |
| Yield Strength | 34,000–41,000 | 35,000 |
| % Elongation | 48–52 | 55 |

*Source — Metals Handbook, Vol. 1, 8th Edition, Page 414 (The mechanical properties of the product of this invention compare favorably with the mechanical properties of wrought Type 308)

D. Finished Product Form

Square rods, 0.234 inch × 0.234 inch × 8 inch, were sheared from the hot rolled plate and were cold swaged to 0.20 inch diameter rods. This represents a reduction in area of approximately 43%. The product is now essentially 100% dense. The cold swaged rods were then drawn through a series of dies, without any intermediate annealing to 0.129 inch in diameter. This is a further reduction in area of approximately 59%. The 0.129 inch rods were coated with a flux and used as stick electrodes. Performance was equal to wrought Type 308L stainless steel electrodes.

EXAMPLE II

Particle mass blended to yield stock exhibiting a high level of homogeneity.

Finished Product-Type 446 modified with 1% Mo, ferritic stainless steel.

A. Prepare Particle Mass

| Constituent | Percent | Particle Size |
|---|---|---|
| Fe-Cr-Mo- | 58.0 | −170 mesh |
| Iron powder | 42.0 | −170 mesh |

Remarks

1. Fe-Cr powder composition: 44.8% Cr; 1.63% Mo; 0.54% C; balance Fe
2. Particle mass composition: 0.32% C; 0.71% $O_2$; 0.0536% $N_2$; 26.6% Cr; 1% Mo; 0.012% S, .033% P; balance Fe
3. Oxygen to carbon plus sulfur ratio 2.2 42.6(approx.)
4. Density: 3.26 grams/cc or 42/6% theoretical density B. Direct Particle Sinter The particle mass is placed, uncompacted, into a supporting structure and sintered for 2 hours, in a dry hydrogen atmosphere, at 1300°C.

Remarks

1. Sintered particle mass composition: 0.0042% C; 0.0272% $O_2$; 0.0055% $N_2$; 0.0015% S; 0.030% P
2. Density: 4.01 grams/cc or 52.3% theoretical density
3. The analysis of this product easily satisfies the required interstitial level of the restrictive Type L grades.

C. Hot Densification

The sintered particle mass is heated to rolling temperature in a protective atmosphere and then hot rolled in one pass from 0.42 inch to 0.142 inch, representing approximately 66% reduction in area.

D. Homogenization Procedure

In order for the final product to exhibit a high level of uniform corrosion resistance, complete homogenization is absolutely essential. The alloy is homogenized by heat treating and cold rolling the densified particle mass in the following manner:

1. Annealed at 1300°C for ½ hour in a hydrogen atmosphere.
2. The annealed product is then cold reduced approximately 40% in cross-section.
3. Second anneal at 1300°C for ½ hour in a hydrogen atmosphere.

E. Product Evaluation

Since the product of this example will be used in corrosive environments, corrosion resistance must be evaluated. It is well known in the art that a product must have a uniform analysis and micro-structure in order to exhibit a high level of corrosion resistance. A microprobe line scan was used to evaluate the composition and homogeneity of the product of this example. This scan showed a uniform distribution of iron, chromium and molybdenum across the product cross-section. The line scan was found to be comparable to line scans performed on samples of wrought modified Type 446.

A particularly severe corrosion test, the ferric sulfate-sulfuric acid test, was used to evaluate the corrosion resistance of the product of this invention. The corrosion rate, in microns per year, measured after exposure to boiling ferric sulfate-50% sulfuric acid for 120 hours follows:

| Sample | Chemical Analysis C PPM | N PPM | O PPM | Cr % | Mo % | Corrosion Rate Microns/Year (1) | (2) |
|---|---|---|---|---|---|---|---|
| Invention (18S) | 47 | 38 | 131 | 26.0 | 1.0 | 703 | 576 |
| Invention (17S) | 15 | 85 | 118 | 26.0 | 1.0 | 439 | 563 |
| Wrought 446 | 30 | 110 | <100 | 24.5 | 1.05 | 700 | 607 |

Corrosion rate (1) represents the weight loss on samples of material after the final homogenization anneal. Corrosion rate (2) represents the weight loss on similar material after .002 inch were mechanically removed from the surface. It is readily apparent that the corrosion resistance of stainless steel stock produced by the method of this invention is comparable to wrought stock.

Stainless steel metallic stock produced by the powder metallurgy process, described herein, is equivalent to wrought stock in physical properties and corrosion resistance. By controlling the parameters of particle mass constitution, homogeneity level and densification metallic stock can be produced for virtually any application.

Aside from the flexibility afforded by these parameters, the resultant stock exhibits a low level of interstitials. Furthermore metallic stock can be produced with smaller roll diameter to stock thickness ratios than heretofore obtainable.

I claim:

1. A powder metallurgy process for producing stainless steel stock having a low level of interstitials and properties equivalent to wrought stainless steel stock comprising the steps of:

providing an uncompacted particle mass formulated to yield metallic stock of a specific alloy composition, homogeneity level and purity level and having a ratio of oxygen to carbon plus sulfur of approximately 1.0:2.5;

heating said uncompacted particle mass in a protective atmosphere to purify the particles to the desired level by the reaction of said oxygen with said carbon and with said sulfur and sinter the particles to form a coherent mass having an interconnected porous structure through which gaseous reaction products are evolved;

ceasing said heating while said coherent mass substantially retains said interconnected porous structure and has a density less than 70% of its theoretical maximum; and hot densifying said coherent mass in a protective atmosphere to cause at least a 40% reduction in cross section and substantial lateral flow in a single pass thereby removing all vestiges of interconnected porosity and bonding the particles together.

2. A powder metallurgy process for producing stainless steel stock having a low level of homogeneity comprising the steps of:

providing an uncompacted particle mass including elemental and pre-alloyed powders with the amount of elemental powders exceeding the amount of pre-alloyed powders and with said particle mass having a ratio of oxygen to carbon plus sulfur of approximately 1.0:2.5;

heating said uncompacted particle mass in a protective atmosphere to purify the particles to the desired level by the reaction of said oxygen with said carbon and with said sulfur and sinter the particles to form a coherent mass having an interconnected porous structure through which gaseous reaction products are evolved;

ceasing said heating while said coherent mass substantially retains said interconnected porous structure and has a density less than 70% of its theoretical maximum; and hot densifying said coherent mass in a protective atmosphere to cause at least a 40% reduction in cross section and substantial lateral flow in a single pass thereby removing all vestiges of interconnected porosity and bonding the particles together.

3. A powder metallurgy process for producing stainless steel stock having a high level of homogeneity comprising the steps of:

providing an uncompacted particle mass including pre-alloy and elemental powders wherein the amount of pre-alloy powders substantially exceed the amount of elemental powders with said particle mass having a ratio of oxygen to carbon plus sulfur of approximately 1.0:2.5;

heating said uncompacted particle mass in a protective atmosphere to lower the level of interstitial elements by the reaction of said oxygen with said carbon and with said sulfur and sinter the particles to form a coherent mass having an interconnected porous structure through which gaseous reaction products are evolved;

ceasing said heating while said coherent mass substantially retains said interconnected porous structure and has a density less than 70% of its theoretical maximum; and hot densifying said coherent mass in a protective atmosphere to cause at least a 40% reduction in cross section and substantial lateral flow in a single pass thereby removing all vestiges of interconnected porosity and bonding the particle together.

4. A powder metallurgy process for producing ferritic stainless steel stock characterized by a high level of homogeneity, excellent corrrosion resistance and a low level of interstitials comprising the steps of:

providing an uncompacted particle mass consisting of Fe-Cr-Mo pre-alloy powder and iron powder and having a ratio of oxygen to carbon plus sulfur of approximately 1.0:2.5;

heating said uncompacted particle mass in a dry hydrogen atmosphere at 1300°C to purify the particles to the desired level by the reaction of said oxygen with said carbon and with said sulfur and sinter the particles to form a coherent mass having an interconnected porous structure through which gaseous reaction products are evolved;

ceasing said heating while said coherent mass substantially retains said interconnected porous structure and has a density less than 70% of its theoretical maximum;

hot densifying said coherent mass in a protective atmosphere to cause in a single pass approximately a 66% reduction in cross section and substantial lateral flow thereby removing all vestiges of interconnected porosity and bonding the particles together.

5. A process as recited in claim 4 wherein the uncompacted particle mass has approximately 58% pre-alloy powder and an overall composition substantially consisting of, in approximate weight percent, 0.32% carbon; 0.71% oxygen; 0.54% nitrogen; 26.6% chromium; 1% molybdenum; 0.012% sulfur and the balance Fe; and the interstitial content of the purified mass has been reduced to at least no more than approximately, in weight percent, 0.0042% carbon; 0.0272% oxygen; 0.0055% nitrogen and 0.0015% sulfur.

6. A powder metallurgy process for producing austinitic stainless steel stock having a low level of interstitials, properties equivalent to wrought austenitic stainless steel and a slightly inhomogeneous structure comprising the steps of:

providing an uncompacted particle mass consisting essentially or iron powder, nickel powder and Fe-Cr pre-alloy powder and having a ratio of oxygen to carbon plus sulfur ob 1.0:2.5;

heating said uncompacted particle mass in a dry hydrogen atmosphere at 1300°C to purify the particles to the desired level by the reaction of said oxygen with said carbon and with said sulfur and sinter the particles to form a coherent mass having an interconnected porous structure through which gaseous reaction products are evolved;

ceasing said heating while said coherent mass substantially retains said interconnected porous structure and has a density less than 70% of its theoretical maximum; and hot densifying said coherent mass in a protective atmosphere to cause at least a 65% reduction in cross section and substantial lateral flow in a single pass thereby removing all vestiges of interconnected porosity and bonding the particles together.

7. A process as recited in claim 1 wherein the ratio of oxygen to carbon plus sulfur in said particle mass is from 1 to 1.6.

8. A process as recited in claim 2 wherein the ratio of oxygen to carbon plus sulfur in said particle mass is from 1 to 1.6.

9. A process as recited in claim 3 wherein the particle mass is composed of powders approximately less than 170 mesh in size.

10. A process as recited in claim 3 wherein the ratio of oxygen to carbon plus sulfur in said particle mass is from 1 to 1.6.

11. A process as recited in claim 5 wherein the particle mass is composed of powders approximately less than 170 mesh in size.

* * * * *